US007395680B2

(12) United States Patent
Baer et al.

(10) Patent No.: US 7,395,680 B2
(45) Date of Patent: Jul. 8, 2008

(54) SELF-CURLING KNITTED SLEEVE AND METHOD OF FABRICATION

(75) Inventors: Angela L. Baer, Westminster, MD (US); Hubert Andrieu, deceased, late of Crepy-en-Valois (FR); by Emeline Andrieu, legal representative, Orrouy (FR); by Mélanie Andrieu, legal representative, St. Jean les deux Jumeaux (FR)

(73) Assignee: Federal Mogul Worldwide, Inc., Southfield, MI (US)

( * ) Notice: Subject to any disclaimer, the term of this patent is extended or adjusted under 35 U.S.C. 154(b) by 7 days.

(21) Appl. No.: 11/616,983

(22) Filed: Dec. 28, 2006

(65) Prior Publication Data

US 2007/0163305 A1 Jul. 19, 2007

Related U.S. Application Data

(63) Continuation-in-part of application No. 11/185,589, filed on Jul. 20, 2005, now Pat. No. 7,216,678.

(60) Provisional application No. 60/657,847, filed on Mar. 2, 2005, provisional application No. 60/589,270, filed on Jul. 20, 2004, provisional application No. 60/782,422, filed on Mar. 15, 2006, provisional application No. 60/754,882, filed on Dec. 29, 2005.

(51) Int. Cl.
*D04B 23/16* (2006.01)

(52) U.S. Cl. ..... 66/170; 66/193; 66/195

(58) Field of Classification Search ..... 66/170, 66/171, 172 R, 192, 193, 195
See application file for complete search history.

(56) References Cited

U.S. PATENT DOCUMENTS

| | | | | |
|---|---|---|---|---|
| 3,255,613 | A * | 6/1966 | Burd | 66/172 R |
| 3,429,147 | A | 2/1969 | Perrier | |
| 3,466,210 | A | 9/1969 | Wareham | |
| 4,022,034 | A | 5/1977 | Matsuda | |
| 4,100,770 | A | 7/1978 | Titone | |
| 4,107,381 | A | 8/1978 | Butzow et al. | |
| 4,174,739 | A | 11/1979 | Rasero et al. | |
| 4,181,514 | A | 1/1980 | Lefkowitz et al. | |
| 4,781,039 | A | 11/1988 | Ribarev et al. | |
| 4,784,886 | A | 11/1988 | Monget et al. | |
| 4,929,478 | A | 5/1990 | Conaghan et al. | |
| 5,178,923 | A | 1/1993 | Andrieu et al. | |
| 5,191,777 | A | 3/1993 | Schnegg | |
| 5,229,176 | A | 7/1993 | Freeman | |

(Continued)

FOREIGN PATENT DOCUMENTS

EP 0 499 089 A1 8/1992

(Continued)

*Primary Examiner*—Danny Worrell
(74) *Attorney, Agent, or Firm*—Robert L. Stearns; Dickinson Wright PLLC

(57) ABSTRACT

A warp knit self-curling fabric and methods of construction thereof provides an elongate sleeve having overlapping edges for protecting elongate members. The fabric includes warp stitches and a plurality of weft stitches. The fabric comprises at least three yarns warp knit together, wherein one of the weft stitches is knit using a tricot stitch of a monofilament under tension to bias the fabric into a self-curled configuration about a central space. The monofilament forms an inner surface of the sleeve.

61 Claims, 2 Drawing Sheets

U.S. PATENT DOCUMENTS

| | | | | |
|---|---|---|---|---|
| 5,300,337 | A | 4/1994 | Andrieu et al. | |
| 5,358,492 | A | 10/1994 | Feibus | |
| 5,428,975 | A * | 7/1995 | Lee et al. | 66/178 R |
| 5,445,599 | A | 8/1995 | Edenbaum | |
| 5,467,802 | A | 11/1995 | Lusen et al. | |
| 5,556,495 | A | 9/1996 | Ford et al. | |
| 5,586,369 | A | 12/1996 | Matsuda et al. | |
| 5,609,701 | A | 3/1997 | Soderberg et al. | |
| 5,692,777 | A | 12/1997 | Tochacek et al. | |
| 5,728,448 | A | 3/1998 | Okeya et al. | |
| 5,843,542 | A | 12/1998 | Brushafer et al. | |
| 6,053,014 | A * | 4/2000 | Cooper | 66/172 E |
| 6,223,565 | B1 * | 5/2001 | Cooper | 66/172 E |
| 6,328,080 | B1 | 12/2001 | Winters | |
| 6,510,872 | B1 | 1/2003 | Smith et al. | |
| 6,709,552 | B2 | 3/2004 | Sakuma et al. | |
| 6,751,831 | B2 | 6/2004 | Willauer et al. | |
| 6,790,213 | B2 | 9/2004 | Cherok et al. | |
| 6,854,298 | B2 * | 2/2005 | Relats et al. | 66/203 |
| 6,936,553 | B2 | 8/2005 | Von Samson-Himmelstjerna | |
| 6,963,031 | B2 | 11/2005 | Gladfelter et al. | |
| 6,978,643 | B2 | 12/2005 | Akers et al. | |
| 7,013,680 | B1 * | 3/2006 | Adams | 66/172 R |
| 7,025,063 | B2 | 4/2006 | Snitkin et al. | |
| 2003/0059562 | A1 | 3/2003 | Lien et al. | |
| 2005/0124249 | A1 | 6/2005 | Uribarri | |

FOREIGN PATENT DOCUMENTS

| | | | |
|---|---|---|---|
| EP | 0 742 626 | A2 | 11/1996 |
| GB | 2089 850 | A | 6/1982 |
| JP | 57-143518 | | 9/1982 |
| JP | 61-9695 | | 1/1986 |
| JP | 135997 | | 5/1989 |
| JP | 2006210228 | | 8/2006 |
| JP | 2006234118 | | 9/2006 |
| WO | WO 97/16587 | | 5/1997 |
| WO | WO 99/50943 | | 10/1999 |

* cited by examiner

SELF-CURLING KNITTED SLEEVE AND METHOD OF FABRICATION

CROSS-REFERENCE TO RELATED APPLICATIONS

This application is a continuation-in-part of U.S. patent application Ser. No. 11/185,589, filed on Jul. 20, 2005 now U.S. Pat. No. 7,216,678, which claims the benefit of U.S. Provisional Patent Application Ser. No. 60/589,270, filed Jul. 20, 2004 and U.S. Provisional Patent Application Ser. No. 60/657,847, filed Mar. 2, 2005. This application also claims the benefit of U.S. Provisional Patent Application Ser. No. 60/754,882, filed on Dec. 29, 2005, and U.S. Provisional Patent Application Ser. No. 60/782,422, filed on Mar. 15, 2006, and incorporates all of these applications herein by way of reference in their entirety.

BACKGROUND OF THE INVENTION

1. Field of the Invention

This invention relates generally to fabrics for forming sleeves for receiving and protecting elongated items such as wiring harnesses and optical fiber cables, and more particularly to warp knitted self-curling fabrics therefor.

2. Background of the Invention

Protective sleeving is used throughout the automotive, marine and aerospace industries to organize and protect elongated items, such as wiring harnesses and optical fiber cables, for example. The sleeving surrounds the elongated items and protects them against cuts, abrasion, radiant heat, vibration induced wear and other harsh environmental threats. When positioned within protective sleeving, the wiring or cables are also held together in a neat bundle, allowing a multiplicity of different items to be handled as a sub-assembly, thus saving time and effort during integration of the items into its end environment.

Protective sleeving may be made by weaving or knitting filaments into a substrate and then resiliently biasing the substrate into a tubular form to define a central space for receiving the elongated items. Biasing may be effected by heating the filaments when the substrate is wrapped about a cylindrical mandrel, wherein the filaments take on a permanent set conforming to the shape of the mandrel. In addition, filaments can also be resiliently biased into a curved shape by applying chemicals thereto, as well as by cold working.

When substrates are biased into a tubular shape via the mechanisms described above, monofilaments are typically oriented in the "hoop" or circumferential direction of the tube. Monofilaments provide excellent stiffness and provide strong resilient biasing that maintains the substrate in the tubular shape. The biased monofilaments also tend to restore the substrate to its tubular shape in the absence of a distorting force, which is generally applied when the sleeve is manipulated to an open state to insert or remove an elongated item.

A significant disadvantage associated with sleeves that are biased into a tubular shape is that the biasing is effected by a separate step in the process of making the sleeve. The filaments comprising the substrate may be biased by cold working before manufacture of the sleeve or may be biased afterward by heating the substrate when wrapped about a mandrel, but these actions constitute an additional process that adds to the cost and the time required to produce the sleeve. Accordingly, it would be advantageous to be able to manufacture a tubular sleeve from a substrate that negates the need for secondary processes to impart the tubular shape on the substrate.

SUMMARY OF THE INVENTION

The invention concerns a knitted self-curling fabric having warp stitches and a plurality of weft stitches. The fabric comprises a chain stitch of a first multi-filament yarn forming the warp stitches, a lay-in stitch of a second multi-filament yarn forming one of the weft stitches and a tricot stitch of a monofilament forming another of the weft stitches. The tricot stitch is positioned predominantly on one face of the substrate. The tricot stitch is knitted under tension and biases the substrate into a self-curled configuration about a central space. To facilitate imparting the bias, the tricot stitch is preferably knitted as a satin stitch.

Another embodiment of a self-curling fabric according to the invention comprises a chain stitch of a first multi-filament yarn forming the warp stitches, a first tricot stitch of a second multi-filament yarn forming one of the weft stitches and a second tricot stitch of a monofilament forming another of the weft stitches. The second tricot stitch is positioned predominantly on one face of the fabric. The second tricot stitch is knitted under tension and biases the fabric into a self-curled configuration about a central space.

Yet another embodiment of a self-curling fabric according to the invention comprises a first chain stitch of a first multi-filament yarn forming the warp stitches, a second chain stitch of a second multi-filament yarn also forming the warp stitches, a lay-in stitch of a third multi-filament yarn forming one of the weft stitches and a tricot stitch of a monofilament forming another of the weft stitches. The tricot stitch is positioned predominantly on one face of the fabric. The tricot stitch is knitted under tension and biases the fabric into a self-curled configuration about a central space.

Another aspect of the invention provides a method of fabricating a self-curling sleeve having a longitudinal axis extending between opposite ends. The method includes warp knitting a plurality of warp yarns and a plurality of first weft yarns together, and inserting a plurality of second weft yarns with the warp yarns and the first weft yarns during the warp knitting step. The second weft yarns cause the first weft yarns to curl about the longitudinal axis.

The embodiments described above may further comprising a filamentary member knitted with the warp and weft stitches. The filamentary member may be positioned predominantly on one face of the substrate and be a heat fusible yarn, an electrically conducting yarn, a thermally insulating yarn, an abrasion resistant yarn, and combinations thereof for tailoring the sleeve to perform a particular function in addition to protecting and bundling of the elongated items.

BRIEF DESCRIPTION OF THE DRAWINGS

These and other aspects, features and advantages of the invention will become readily appreciated when considered in connection with the following detailed description of the presently preferred embodiments and best mode, appended claims and accompanying drawings, wherein:

DETAILED DESCRIPTION OF PRESENTLY PREFERRED EMBODIMENTS

Figure 1:
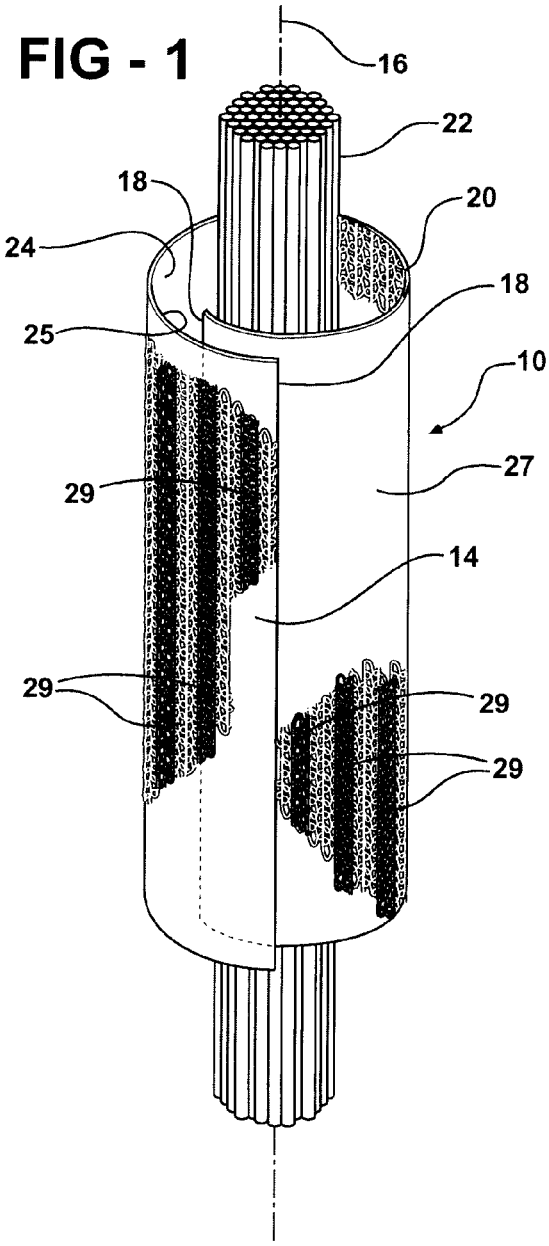
FIG. 1 is a perspective view of a protective sleeve according to one presently preferred embodiment of the invention constructed from a self-curling knitted fabric.
Figure 2:
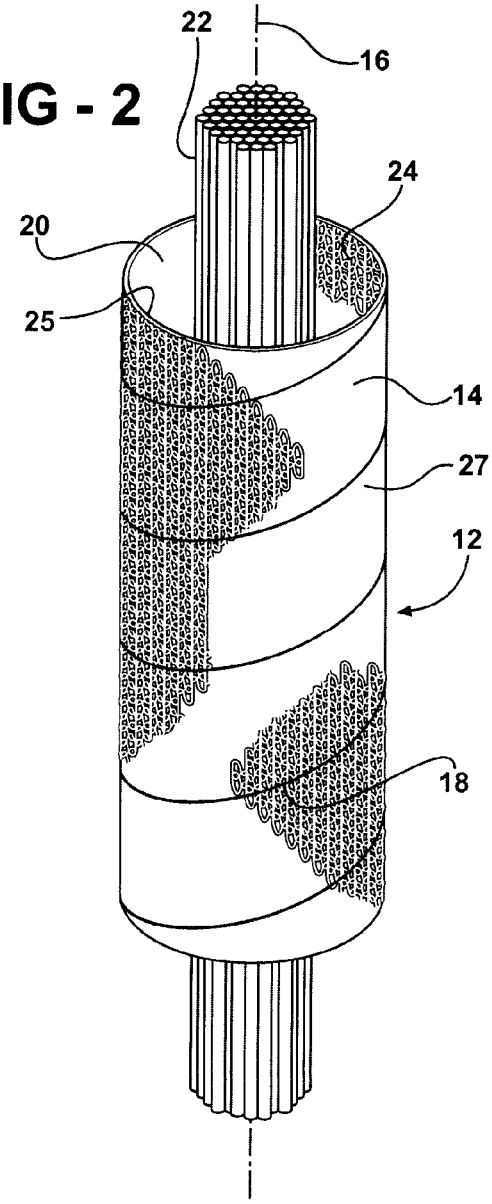
FIG. 2 is a perspective view of a protective sleeve according to another presently preferred embodiment of the invention constructed from a self-curling knitted fabric.

Referring in more detail to the drawings, FIG. 1 illustrates an elongate protective sleeve 10 constructed in accordance with one presently preferred embodiment of the invention, while FIG. 2 illustrates an elongate protective sleeve 12 constructed in accordance with another presently preferred embodiment of the invention. The sleeves 10, 12 are only representative of some presently preferred sleeve constructions, and thus, the invention is not limited to these embodiments. The sleeves 10, 12 are formed from a self-curling knitted substrate 14 that self-curls upon being knitted about a longitudinal axis 16 of the sleeves 10, 12 to define a generally enclosed and protected central space 20. The knitted substrate, referred to hereafter as fabric 14 unless specifically stated otherwise, has opposite selvages, referred to hereafter as free edges 18, which either extend parallel to the axis 16 (the so-called "cigarette" wrap construction) or in a helical path about the axis 16. Regardless, both sleeves 10, 12 provide the central space 20 that receives elongated items 22 to be protected, such as a wiring harness or optical fibers, for example. The free edges 18 are unbound, and thus, can be opened by applying a force sufficient to overcome the self-curling biasing force imparted by the fabric 14. As such, the free edges 18 can be unwrapped in spaced relation to one another to an open position. When the free edges 18 are in their unwrapped position, the elongated items can either be disposed into the central space 20, or removed therefrom. Upon inserting or removing the elongated items, the applied external force separating the free edges 18 in spaced relation from one another can be released, whereupon the free edges 18 return to their naturally biased, self-curled position, wherein the free edges 18 preferably overlap one another to enclose the central space 20.

The fabric 14 of the sleeves 10, 12 can be made through weft insertion of filaments during warp knitting, or also by warp knitting alone, to produce the force imbalance necessary to induce the fabric 14 to self-curl. The fabric 14 is knitted, preferably using crochet techniques, wherein the movement of needles and guides is horizontal, such as on an Acotronic 400 Crochet machine, for example. As such, the fabric 14 is knitted as a crochet flat knit structure that self-curls into the tubular sleeve 14 upon release of the yarns from the knitting needles. Accordingly, the sleeve 14 takes on its tubular shape wherein the free edges 18 are arranged in overlapping relation with one another without need for secondary processes, such as heat setting, for example. The fabric 14 is preferably warp knitted with the warp-wise direction being substantially parallel to the longitudinal axis 16 and the weft-wise direction being substantially perpendicular to the warp-wise direction.

The fabrics 14 are formed using a combination of filamentary members including both multi-filament yarns and monofilaments. The multifilament yarns are generally the basis of the knit fabric 14 and provide flexibility to the fabric 14 and form the basis for coverage of the elongated items 22. The monofilaments are generally stiffer elements and are knitted under tension, with the tension preferably being maintained constant throughout the knitting process, such that the tension on the monofilaments is greater than any balanced tension imparted on the multifilament yarns. Being predominantly located on one face 24 of the fabric 14, the tension imparted by the monofilaments provides a bias affecting the self-curling characteristics of the fabric 14. The one face 24 on which the monofilaments are located becomes an inwardly facing concave surface 25 of the sleeve 10, 12.

Various example embodiments of the fabric 14 are described below with reference to specific stitch types, needle notation and materials used. It should be recognized that the resulting self-curling fabric 14 is not limited to these specific examples. The schematic stitch illustrations show the presently preferred stitches used to construct the fabric examples, with the various stitches being illustrated separate from one another for clarity. It is to be understood that the various stitches are not formed separate from one another, but are knitted with one another to form the fabric 14 on the crochet machine.

Each stitch diagram represents a separate bar on the crochet knitting machine that carries a plurality of yarns or monofilaments knitted in the stitch that is illustrated. In the first two fabric examples illustrated in FIGS. 3 and 4, two bars carry multi-filament yarns which form the warp stitches and weft stitches that provide the basic foundation for the fabric 14. The knitting tensions are preferably balanced for these multifilament yarns to prevent deformation of the resulting fabric 14, and thus, these knitted multifilament yarns would generally form a flat fabric if not for a monofilament stitch which is knitted under an increased tension from a third bar. The third bar carries the monofilament, which, as mentioned, is knitted under an increased tension relative to that of the multifilament yarns, with the tension being closely controlled and maintained under a generally constant preload throughout the knitting process. The third bar introduces the monofilament predominantly on one face 24 of the fabric 14 so that the increased tension on that face 24 biases the fabric 14 into the self-curled, tubular shape. In action, the third bar traverses in a pattern moving from the left side of a first needle to the right side of a final needle on the machine. This action is replicated on every weft insertion eye over the entire width of the fabric 14. The traversing third bar produces a herring bone pattern on the face 24 of the fabric 14 having the monofilament stitches. Due to the traversal under tension, the monofilament is elastically stretched under a preload, and thus, energy is stored in the monofilament. When the monofilament is released from the needles, the energy stored by the preload tension is released, thus, allowing the associated monofilament to resiliently pull inwardly and assume its unstretched length. Accordingly, the monofilaments cause the remaining multifilament yarns to be pulled conjointly therewith, thus, causing the multifilaments to be curled about the longitudinal axis 16 of the sleeve 10, 12, wherein the warp-wise multifilaments predominately form an outer convex surface 27 of the sleeve 10, 12, while the weft-wise monofilaments 30 predominately form the inner concave surface 25 of the sleeve 10, 12.

SUBSTRATE EXAMPLE 1

Figure 3:
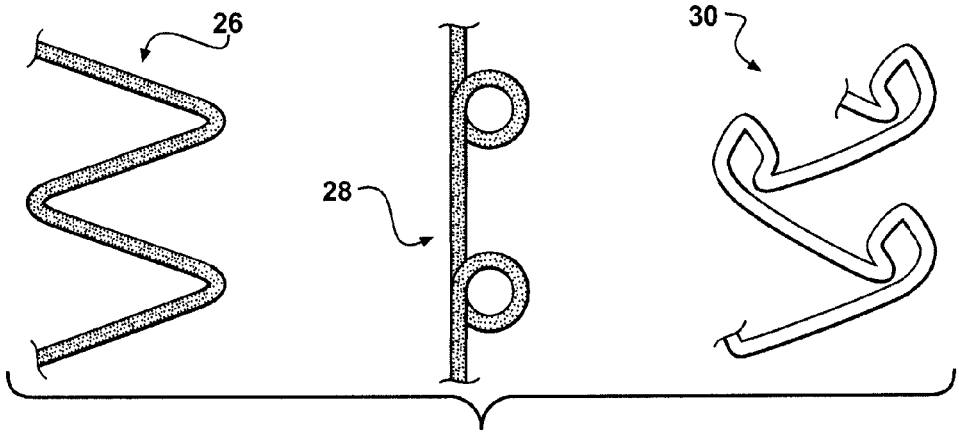
FIG. 3 is a schematic diagram illustrating knit stitches used in fabricating a self-curling sleeve according to one presently preferred embodiment.

FIG. 3 schematically illustrates the yarns and stitches used to construct Fabric Example 1. The fabric 14 has one yarn is knitted with a (4-1, 4-1) lay-in stitch 26 over four needles on a first bar, another yarn is knitted with a (2-1, 2-1) closed chain stitch 28 on a second bar, and another yarn is knitted with an (5-4, 1-2) or (4-3, 1-2) open tricot satin stitch 30 on a third bar of a knitting machine (not shown). The laying-in stitch 26, also referred to as lay-in or laid-in stitch, and the chain stitch 28 are knitted under a generally balanced tension relative to one another, while the open tricot stitch 30, and preferably a satin or super-satin tricot stitch, is knitted under an increased constant tension relative to the laying-in and chain stitches 26, 28, thus, imparting a self-curling bias on the resulting fabric 14. In the actual samples produced, multifilament yarn of 350 denier formed of PET filaments was used for the laying-in stitch 26, and multifilament yarn of 350 denier and formed of PET filaments was used for the closed chain stitch 28, which forms the basis of the outer convex surface 27. The open tricot stitch 30 was formed of 10 mil PET monofilament, and forms the basis of the inner concave surface 25. These yarn sizes are only by way of example, and thus, it should be recognized that the sizes could be different, depending on the application. This example has strong self-curling tendencies and was producible in a range of sizes from about 4-38 mm in diameter. This example embodies the classical crochet techniques and tends to have less end fray when cold-cut due to the effect of the closed chain stitch 28 which locks the multifilament laid-in yarn 26 and the monofilament open tricot stitch 30 into the fabric 14. The reduced end fray is also facilitated by the open tricot stitch 30, which results in less yarn being cut in a comparable unit area than if a closed tricot stitch were used. In addition, by using an open tricot stitch 30, less yarn is required in fabrication of the sleeve 10, 12, thereby resulting in a cost savings and providing a lighter finished product.

In a related example to Example 1, the plurality of closed chain stitch yarns 28 may comprise one or more monofilaments in place of some of the multi-filament chain stitch yarns over a plurality of wales 29, thereby creating one or more wales of close chain stitch monofilament yarns extending along the length of the sleeve fabric 14. Such circumferentially spaced monofilament wales 29 enhance the abrasion resistance and provide increased protection to the adjacent multifilament yarns. Accordingly, the sleeve 10, 12 could contain both monofilament and multifilament warp-wise chain stitches 28, 29 on the outer convex surface 27. As mentioned above, this example embodies the classic crochet techniques and tends to have less end fray when cold-cut due to aforementioned reasons.

SUBSTRATE EXAMPLE 2

Figure 4:
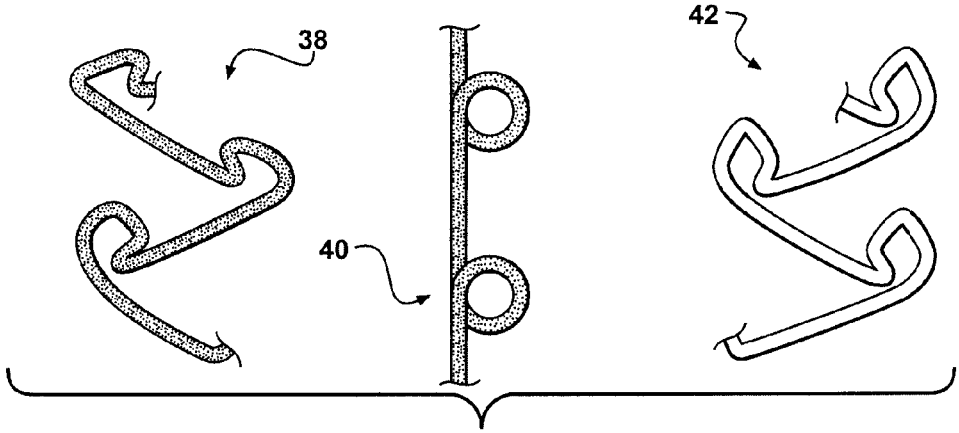
FIG. 4 is a schematic diagram illustrating knit stitches used in fabricating a self-curling sleeve according to another presently preferred embodiment.

FIG. 4 schematically illustrates the yarns and stitches used to construct Fabric Example 2. The fabric 14 has one yarn knitted with an open tricot stitch 38 on a first bar, another yarn knitted with a closed chain stitch 40 on a second bar, and another yarn knitted with an open tricot stitch 42 on a third bar of a warp knitting machine (not shown). In the actual sample produced, multifilament yarn of 350 denier formed of PET filaments was used for the first open tricot stitch 38, multifilament yarn also of 350 denier and formed of PET filaments was used for the closed chain stitch 40. The open tricot stitch 42 which forms the basis of the inner convex surface 25 was formed of 10 mil PET monofilament. This example uses only open tricot stitches and closed chain stitches, with the lay-in stitch discussed above in Example 1 being absent. The needle notation for the open tricot stitches 42 and the closed chain stitches are the same as in Example 1. Also, the yarn sizes selected could be different, as best suited for the intended application.

SUBSTRATE EXAMPLE 3

Figure 5:
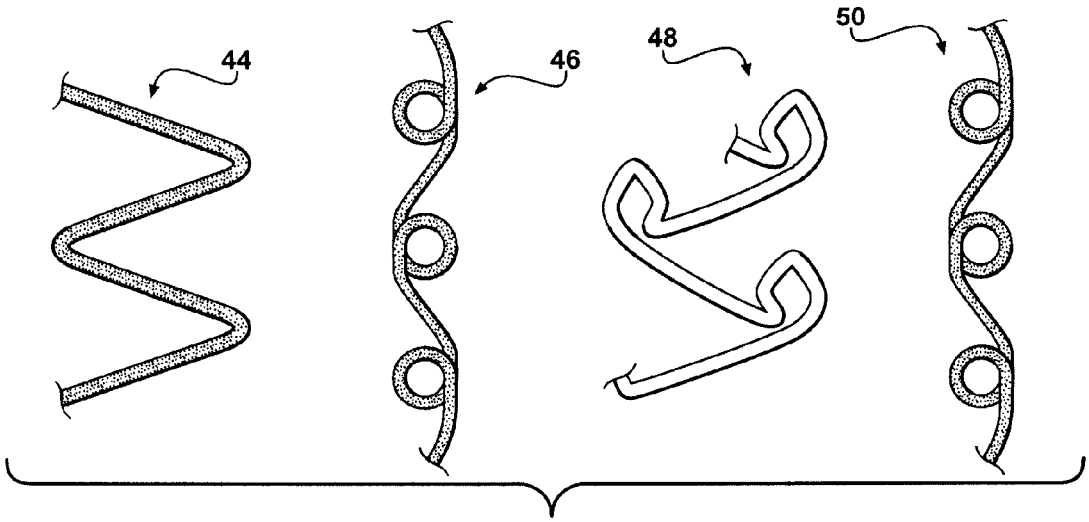
FIG. 5 is a schematic diagram illustrating knit stitches used in fabricating a self-curling sleeve according to yet another presently preferred embodiment.

FIG. 5 schematically illustrates the yarns and stitches used to construct Fabric Example 3. The fabric 14 has one yarn knitted with a lay-in stitch 44 over four needles on a first bar, another yarn knitted with a closed chain stitch 46 on a second bar, another yarn knitted in an open satin or super-satin tricot stitch 48 on a third bar, and another yarn knitted with a closed chain stitch 50 on a fourth bar of a knitting machine (not shown). In the actual sample produced, multifilament yarn of 2×167 dTex formed of PET filaments was used for the lay-in stitch 44 and for both closed chain stitches 46 and 50. The open tricot stitch 48 was formed of 0.010 inch PET monofilament. Having two bars of closed chain stitches 46 and 50 mark this example as a classic crochet knit fabric. The needle notation for the lay-in stitch 44, the open tricot stitches 48 and the closed chain stitches 46, 50 are the same as in Example 1. Also, as with the previous embodiments discussed, the yarn sizes selected could be different, as best suited for the intended application.

Although specific deniers for the yarns and diameters for the monofilaments are provided in the examples above, as mentioned, it is understood by those possessing ordinary skill in the crocheting and knitting arts that other yarn deniers and monofilament diameters are also feasible. In fact, fabric 14 constructed in accordance with the invention could be made with multifilament yarns ranging between about 100-1000 denier and monofilaments ranging between about 6-12 mils. In addition, unidirectional and semi-unidirectional filaments can be added, such as by being knitted or served with the warp and weft stitches for increased product performance, such as, for mechanical, EMI/RF and/or thermal shielding, for example. Some preferred additions could be aramid, electrical or EMI/RF shielding materials, polyarnide, glass, PPS, and PEEK, for example, depending on the application. Other additions of fire-retardant, chemical resistant, heat fusible, electrically conductive, thermally insulative, and abrasion resistant yarns or filaments are also anticipated.

In accordance with another aspect of the invention, methods of fabricating the sleeves described above are embodied herein, including warp knitting and weft-insertion warp knitting. One such method for fabricating a self-curling having a longitudinal axis extending between opposite ends includes warp knitting a plurality of warp yarns and a plurality of first weft yarns together, and inserting a plurality of second weft yarns with the warp yarns and the first weft yarns during the warp knitting step. The insertion of the second weft yarns under tension causes the first weft yarns to curl about the longitudinal axis upon release of the second weft yarns from the knitting process. Accordingly, no secondary processes or fastening mechanisms are required to bring the sleeve into its curled shape.

Additional aspects of the method of fabrication can further include using a multifilament yarn for the warp yarns and for the first weft yarns. In addition, the method contemplates using a monofilament for the second weft yarns, wherein the monofilament is inserted under tension, as already discussed. Further, the method contemplates using a monofilament for at least one of the warp yarns or the first weft yarns. It should be recognized that some of these methods can be used in combination with one another, while some require the exclusion of others. For example, if a specified yarn is a monofilament, then it can not be at the same time a multifilament. Of course, this will be readily apparent to those having ordinary skill in the art of textile fabrics.

Self curling fabrics fabricated according to the invention provide a protective sleeve that accommodates elongated items, and that may be manufactured more economically by avoiding additional process steps associated biasing the substrate into a curled sleeve in secondary operations, such as by cold working, heat treatment or chemical processes. As mentioned, they also eliminate the necessity for fasteners to maintain the sleeves in their tubular shape, although, if desired, various fastening mechanisms could be incorporated to provide a redundant closure mechanism, such as hook and loop fasteners, for example.

Obviously, many modifications and variations of the present invention are foreseeable in light of the above teachings. It is, therefore, to be understood that within the scope of the appended claims, the invention may be practiced otherwise than as specifically described for the presently preferred embodiments.

What is claimed is:

1. An elongate self-curling sleeve for protecting elongated members, said sleeve, comprising:

a knitted fabric having opposite free edges extending along a longitudinal axis of said sleeve, said free edges being biased in overlapping relation and being separable under an externally applied force for receiving and removing said elongate members;

a first yarn forming chain stitches extending in a warp direction along said longitudinal axis, said chain stitches being formed predominately on one face of said fabric;

a second yarn forming laying-in stitches extending along a weft direction between said free edges; and a third yarn of monofilament knitted under tension in tricot stitches extending in the weft direction between said free edges, said tricot stitches being formed predominantly on another face of said fabric opposite said one face and biasing said fabric in a self-curled configuration about said longitudinal axis under said tension.

2. The self-curling sleeve of claim 1 wherein said chain stitches are closed chain stitches.

3. The self-curling sleeve of claim 1 wherein said tricot stitches are open tricot stitches.

4. The self-curling sleeve of claim 3 wherein said open tricot stitches are satin stitches.

5. The self-curling sleeve of claim 1 wherein said one face is convex and said another face is concave.

6. The self-curling sleeve of claim 1, further comprising a filamentary member knitted with said warp and weft stitches, said filamentary member being positioned predominantly on said one face of said substrate.

7. The self-curling sleeve of claim 6, wherein said filamentary member comprises a yarn selected from the group consisting of a heat fusible yarn, an electrically conducting yarn, a thermally insulating yarn, an abrasion resistant yarn, and combinations thereof.

8. The self-curling sleeve of claim 1 further comprising another yarn forming chain stitches extending in a warp direction along said longitudinal axis.

9. The self-curling sleeve of claim 8 wherein said another yarn is a multifilament.

10. The self-curling sleeve of claim 1 wherein said chain stitches of said first yarn are knitted at least partially with multifilament yarn.

11. The self-curling sleeve of claim 10 wherein said chain stitches of said first yarn are knitted at least partially with monofilament yarn to form circumferentially spaced monofilament wales.

12. The self-curling sleeve of claim 10 wherein said laying-in stitches of said second yarn are knitted with multifilament yarn.

13. A self-curling sleeve having knitted warp stitches and a plurality of weft stitches, comprising:

a chain stitch of a first yarn forming said warp stitches;

a first tricot stitch of a second yarn forming one of said weft stitches; and a second tricot stitch of a monofilament forming another of said weft stitches predominantly on one face of said sleeve, said second tricot stitch being knitted under tension and biasing said sleeve into a self-curled configuration about a central space.

14. The self-curling sleeve of claim 13 wherein said chain stitch is a closed chain stitch.

15. The self-curling sleeve of claim 13 wherein said second tricot stitch is a satin stitch.

16. The self-curling sleeve of claim 13 wherein said first yarn is a multifilament.

17. The self-curling sleeve of claim 16 wherein said second yarn is a multifilament.

18. The self-curling sleeve of claim 13 further comprising another yarn selected from the group consisting of a heat fusible yarn, an electrically conducting yarn, a thermally insulating yarn, an abrasion resistant yarn, and combinations thereof.

19. The self-curling sleeve of claim 13 wherein said first yarn is knitted using monofilament yarn and multifilament yarns, said monofilament yarn forming circumferentially spaced wales extending along a length of said sleeve.

20. A self-curling knitted sleeve having a plurality of warp stitches and a plurality of weft stitches, comprising:

a first chain stitch of a first yarn forming one of said warp stitches;

a second chain stitch of a second yarn forming another of said warp stitches;

a lay-in stitch of a third yarn forming one of said weft stitches; and a tricot stitch of a monofilament forming another of said weft stitches, said tricot stitch being positioned predominantly on one face of said sleeve and being knitted under tension to bias said sleeve into a self-curled configuration about a central space.

21. The self-curling sleeve of claim 20 wherein said lay-in stitch is formed over four needles.

22. The self-curling sleeve of claim 20 wherein said tricot stitch is an open tricot stitch.

23. The self-curling sleeve of claim 20 wherein said tricot stitch is a satin stitch.

24. The self-curling sleeve of claim 20 wherein said first chain stitch is a closed chain stitch.

25. The self-curling sleeve of claim 24 wherein said second chain stitch is a closed chain stitch.

26. The self-curling sleeve of claim 20 wherein said first yarn is a multifilament.

27. The self-curling sleeve of claim 26 wherein said second yarn is a multifilament.

28. The self-curling sleeve of claim 26 wherein said second yarn is a monofilament.

29. The self-curling sleeve of claim 27 wherein said third yarn is a multifilament.

30. The self-curling sleeve of claim 20 wherein said one face forms an inner concave surface of said sleeve.

31. A method of fabricating a self-curling sleeve having a longitudinal axis extending between opposite ends, comprising:

warp knitting a plurality of warp yarns and a plurality of first weft yarns together; and inserting a plurality of second weft yarns with said warp yarns and said first weft yarns during said warp knitting step, said second weft yarns causing said first weft yarns to curl about said longitudinal axis.

32. The method of claim 31 further including imparting a tension force on said second weft yarns so that they are inserted under tension during said inserting step.

33. The method of claim 31 further including using a multifilament yarn for said warp yarns.

34. The method of claim 33 further including using a multifilament yarn for said first weft yarns.

35. The method of claim 34 further including using a monofilament for said second weft yarns.

36. The method of claim 33 further including using a monofilament for said second weft yarns.

37. The method of claim 31 further including using a monofilament for at least one of said warp yarns or said first weft yarns.

38. The method of claim 31 further including using a chain stitch for at least some of said warp yarns.

39. The method of claim 38 further including using a tricot stitch for said second weft yarns.

40. A method of fabricating an elongate self-curling sleeve for protecting elongate members on a warp knitting machine, comprising:

warp knitting three yarns together to construct a self-curling fabric having opposite free edges arranged to overlap one another upon exiting the warp knitting machine; and providing a first of said three yarns as a monofilament and knitting said monofilament under tension using tricot stitches extending in a weft direction between said free edges, said tricot stitches being formed predominantly on a face of said sleeve that forms an inner surface of said sleeve.

41. The method of claim 40 further including using open satin stitches for said tricot stitches.

42. The method of claim 40 further including providing a second of said three yarns as a multifilament and knitting said multifilament to form an outer surface of said sleeve.

43. The method of claim 42 further including using a closed chain stitch for said second yarn.

44. The method of claim 42 further including providing a third of said yarns as a multifilament.

45. The method of claim 44 further including using a laying-in stitch for said third yarn.

46. The method of claim 40 further including providing a second of said three yarns as a multifilament and knitting said second yarn using a chain stitch to form an outer surface of said sleeve.

47. The method of claim 46 further including using a closed chain stitch for said chain stitch.

48. The method of claim 46 further including providing a third of said yarns as a multifilament and knitting said third yarn using a laying-in stitch.

49. The method of claim 40 further including knitting a fourth yarn with said three yarns.

50. The method of claim 49 further including using chain stitches for two of said four yarns.

51. The method of claim 50 further including using a laying-in stitch for one of said four yarns.

52. The method of claim 50 further including using a multifilament yarn for at least one of said chain stitches.

53. The method of claim 52 further including using multifilament yarns for two of said chain stitches.

54. The method of claim 52 further including using a monofilament for the other of said chain stitches.

55. The method of claim 53 further including using a laying-in stitch for one of said four yarns.

56. The method of claim 55 further including using a multifilament yarn for said laying-in stitch.

57. The method of claim 42 further including providing a second of said three yarns as a multifilament and knitting said second yarn using a tricot stitch.

58. The method of claim 57 further including knitting said second yarn as an open tricot stitch.

59. The method of claim 57 further including providing a third of said three yarns as a multifilament.

60. The method of claim 59 further including knitting said third yarn using a chain stitch.

61. The method of claim 60 further including knitting said chain stitch as a closed chain stitch.

* * * * *